United States Patent [19]

Roberts et al.

[11] Patent Number: 4,644,783

[45] Date of Patent: Feb. 24, 1987

[54] ACTIVE CONTROL OF ACOUSTIC INSTABILITY IN COMBUSTION CHAMBERS

[75] Inventors: John P. Roberts; Maxime L. Vuillermoz, both of London, United Kingdom

[73] Assignee: National Research Development Corp., London, England

[21] Appl. No.: 755,313

[22] Filed: Jul. 15, 1985

[30] Foreign Application Priority Data

Jul. 16, 1984 [GB] United Kingdom ..... 8418056

[51] Int. Cl.[4] ..... G01M 15/00

[52] U.S. Cl. ..... 73/116; 181/200; 431/114

[58] Field of Search ..... 73/116; 181/204, 206; 381/71; 431/114

[56] References Cited

U.S. PATENT DOCUMENTS

| | | | |
|---|---|---|---|
| 2,951,473 | 9/1960 | Bodine | 181/206 |
| 3,601,985 | 8/1971 | Bauger | 431/114 |
| 3,602,331 | 8/1971 | Bschorr | 181/206 |
| 3,620,013 | 11/1971 | Rogers et al. | 431/114 |
| 4,025,724 | 5/1977 | Davidson, Jr. et al. | 181/206 |

FOREIGN PATENT DOCUMENTS

| | | |
|---|---|---|
| 0040774 | 12/1981 | European Pat. Off. . |
| 1495015 | 12/1977 | United Kingdom . |

*Primary Examiner*—Jerry W. Myracle
*Assistant Examiner*—Robert R. Raevis
*Attorney, Agent, or Firm*—Cushman, Darby & Cushman

[57] ABSTRACT

A combustion chamber subject to the build-up of acoustic vibrations may have the vibrations inhibited by an electrode system which can be modulated to produce anti-noise. Sound is sensed by a microphone which may be mounted remotely to produce a control signal coupled to a voltage generator feeding the electrode system.

6 Claims, 2 Drawing Figures

ACTIVE CONTROL OF ACOUSTIC INSTABILITY IN COMBUSTION CHAMBERS

This invention relates to combustion systems and, in particular to a method of reducing acoustic vibrations within such systems.

Associated with combustion of fuel devices such as boilers or internal combustion engines is the creation of acoustic energy. Resonances occur at certain frequencies determined by the dimensions of the device and if acoustic energy is generated at these frequencies harmful vibrations build up. In severe cases these vibrations can cause destruction of the device.

Various methods have been proposed to overcome the adverse effects of these generations in combustion systems.

In French Pat. No. 2490786 a microphone senses the level of noise produced by a flame and is used to generate a monitor signal dependent thereon. This monitor signal is then used to control the combustion conditions to minimise noise generations.

In British Pat. No. 1495015 sound generated by a flame is used to modulate the flow of one of the reactants to the combustion chamber. This in turn controls variations in the time resolved characteristics of the flame, such as radiation or acoustic noise.

European Pat. No. 0040774 disclosed an internal combustion engine with means for retarding the ignition signal at high engine speeds in order to reduce combustion noise.

It has now been found that the build-up of acoustic vibrations within an internal combustion system can be inhibited by a relatively small anti-phase acoustic signal generated by an electrical discharge between electrodes placed within the combustion chamber.

Accordingly the present invention provides a combustion system having at least one chamber for the combustion of gaseous or vaporized reactants sensing means responsive to acoustic noise within said chamber to produce an electrical signal dependent on the amplitude, frequency and phase of said acoustic noise, control circuit means connected to said sensing means to produce an electrical control signal and transducer means to receive said electrical control signal and to generate therefrom an acoustic signal in anti-phase with said acoustic noise.

Figure 1:
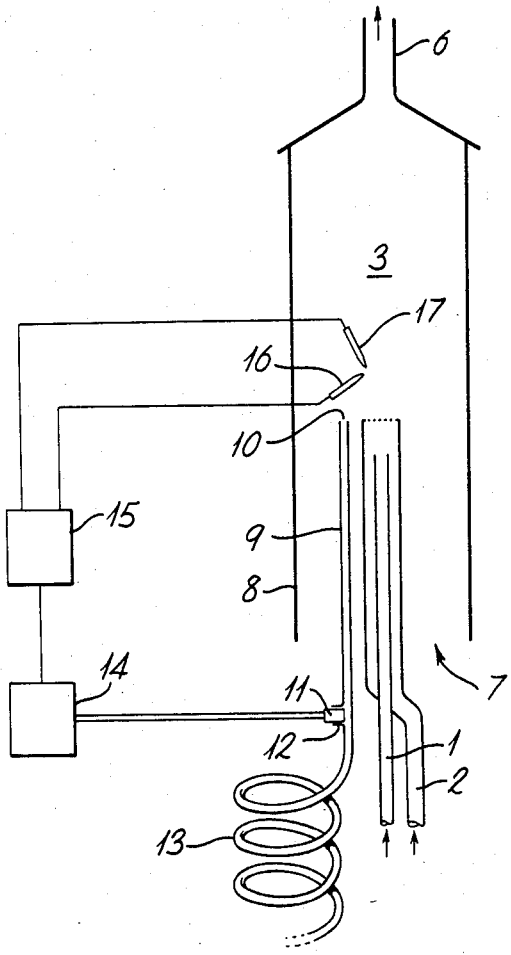
Figure 2:
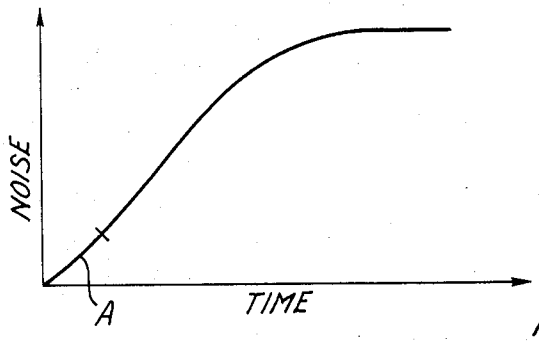

An embodiment of the invention will now be described by way of example with reference to the accompanying drawings in which:

FIG. 1 shows in diagrammatic form a combustion system incorporating an electrical arc for reducing acoustic noise, FIG. 2 is a graph depicting the control characteristics of the apparatus.

Referring to the drawing, a combustible mixture of gases is fed by way of supply pipes 1, 2 to a combustion chamber 3 in which it is burned. Exhaust gases are led from the combustion chamber by an exhaust tube 6. A probe tube 9 enters the combustion chamber by way of an open end 7. One end 10 of the tube is positioned within the combustion chamber at a point where noise is generated by the combustion process. A microphone 11 is mounted at a port 12 in the portion of the tube outside the combustion chamber. The tube 9 extends for a substantial distance beyond the port in order to provide non-resonant acoustic loading which give a smooth response. In order to accommodate the length, the tube is in the form of a coil 13. Preferably, also, the distance between the end of the probe tube and the microphone of the probe tube is short in comparison with the wavelength of the acoustic noise generated in the boiler, in order to obviate the effects of time of passage of the acoustic signal between generation and detection.

The output signal from the microphone is amplified and inverted in phase in an amplifier/phase shift circuit 14. The acoustic frequency alternating current signal thus produced is superimposed on voltage produced by a power supply 15. The composite control signal is fed to electrodes 16, 17 within the combustion chamber. An arc is struck between the electrodes. The phase shift necessary to provide cancellation may be achieved by microprocessor control of the phase shift circuit.

FIG. 2 of the drawings depicts the build-up of noise generated within the combustion chamber as a function of time. Ideally the control signal is applied by the arc during the initial period (marked A on the graph) of acoustic noise build-up. At this stage, only a relatively small control signal need be used to suppress noise generation, whereas if the combustion system is already generating large amounts of noise a substantially greater amount of energy is required to eliminate it.

Preferably this anti-noise source is positioned at the point of generation of acoustic noise. However, since the wavelength of sound at the critical frequencies is large, this requirement is not critical.

Under certain circumstances it is desirable to have more than one microphone probe tube and more than one suppression arcs positioned at different locations within the combustion chamber.

As an alternative to placing a probe tube at the position at which noise is generated, alternative means such as the provision of an elliptical reflector or an acoustic lens may be used to direct sound to a remote microphone.

Under certain circumstances it is possible to control broad band or free field noise emission by selective control of critical frequencies or bands. It is also possible to control noise by electrodes at a point remote from the noise sensing position. In this case phase shift for cancellation has to be calculated by taking into account the phase shift in the combustion path between the sensor and the electrode. If the sensor is downstream a negative feedback loop may be created with corresponding improvement in stability.

Advantageously, a plurality of anti-noise generator electrodes and/or sensors may be used to compensate for difficult resonance patterns within the combustion chamber at different frequencies. Since it is possible to inhibit predetermined noise frequencies it may be preferable deliberately to make its combustion chamber resonant.

A plurality of electrodes at separate locations may be used to simulate a linear filter array.

One application of the invention is to change the noise spectrum of engines.

Alternative pressure sensing arrangements may be employed in place of the microphone.

Advantageously, the electrodes may be of metal and may be provided with ducts for the passage of cooling fluid.

In an alternative embodiment, the microphone together with suitable cooling arrangements may be mounted within the combustion chamber, or adjacent to in the region of noise generation.

The noise reduction method described above has been found to be effective under both laminar and tubulent flow conditions.

We claim:

1. A combustion system comprising:

at least one chamber for the combustion of gaseous or vaporized reactants, sensing means responsive to acoustic noise within said chamber to produce an electrical signal dependent on the amplitude, frequency and phase of said acoustic noise, control circuit means connected to said sensing means to produce an electrical control signal and transducer means to receive said control signal and to generate therefrom an acoustic signal in anti-phase with said acoustic noise, said transducer comprising an electrical arc struck between electrodes within the combustion chamber.

2. A combustion system as claimed in claim 1 incorporating means for sensing acoustic noise sensitive to predetermined frequencies and transducer means to generate anti-phase acoustic signals at further predetermined critical frequencies in response to control signals produced by said means for sensing acoustic noise.

3. A combustion system as claimed in claim 1 in which the combustion chamber is adapted to resonate at a predetermined frequency and the control circuit means and transducer means are adapted to produce an acoustic signal in anti-phase at said predetermined frequency.

4. A combustion system as claimed in claim 1 wherein the sensing means comprises a microphone together with conduct means for conducting the acoustic noise from its source thereto.

5. A combustion system comprising:

at least one chamber for the combustion of gaseous or vaporized reactants, sensing means responsive to acoustic noise within said chamber to produce an electrical signal dependent on the amplitude, frequency and phase of said acoustic noise, control circuit means connected to said sensing means to produce an electrical control signal and transducer means to receive said control signal and to generate therefrom an acoustic signal in anti-phase with said acoustic noise, wherein the sensing means comprises a microphone together with conduit means for conducting the acoustic noise from its source thereto, wherein said means for conducting the acoustic noise comprises a tube having an open end adjacent to a region of generation of said acoustic noise.

6. A combustion system as claimed in claim 5 wherein said tube extends beyond said microphone.

* * * * *